US011629922B2

(12) United States Patent
Mossman

(10) Patent No.: US 11,629,922 B2
(45) Date of Patent: Apr. 18, 2023

(54) COMPACT RECOIL SPRING BUFFER APPARATUS

(71) Applicant: Aviator Arms LLC, Olmsted Township, OH (US)

(72) Inventor: Michael J. Mossman, Olmsted Township, OH (US)

(73) Assignee: Aviator Arms LLC, Olmsted Township, OH (US)

( * ) Notice: Subject to any disclaimer, the term of this patent is extended or adjusted under 35 U.S.C. 154(b) by 0 days.

(21) Appl. No.: 17/549,993

(22) Filed: Dec. 14, 2021

(65) Prior Publication Data

US 2022/0187036 A1 Jun. 16, 2022

Related U.S. Application Data

(60) Provisional application No. 63/260,198, filed on Aug. 12, 2021, provisional application No. 63/199,236, filed on Dec. 15, 2020.

(51) Int. Cl.
*F41A 3/86* (2006.01)
*F41A 3/66* (2006.01)

(52) U.S. Cl.
CPC . *F41A 3/86* (2013.01); *F41A 3/66* (2013.01)

(58) Field of Classification Search
CPC ..... F41A 3/86; F41A 3/66
See application file for complete search history.

(56) References Cited

U.S. PATENT DOCUMENTS

| | | | | |
|---|---|---|---|---|
| 5,448,940 | A | 9/1995 | Schuetz et al. | |
| 6,079,138 | A * | 6/2000 | Meaker | F41A 3/44 89/187.02 |
| 9,032,860 | B2 | 5/2015 | Faxon | |
| 10,443,964 | B2 | 10/2019 | Brown | |
| 11,215,413 | B2 * | 1/2022 | Satzinger | F41C 7/00 |
| 2018/0010879 | A1 * | 1/2018 | Bonine | F41A 3/84 |

* cited by examiner

*Primary Examiner* — J. Woodrow Eldred
(74) *Attorney, Agent, or Firm* — Wood Herron & Evans LLP

(57) ABSTRACT

An AR-pattern firearm comprises an upper receiver, a housing positioned above the upper receiver and containing a recoil spring assembly, a bolt carrier assembly positioned in the upper receiver, and a bridge plate operably connecting the bolt carrier assembly to the recoil spring assembly. Discharge of the firearm causes rearward movement of the bolt carrier assembly out of battery and hence rearward movement of the bridge plate which stores energy in the recoil spring assembly, whereupon the stored energy in the recoil spring assembly causes the bolt carrier assembly to move forward back into battery.

16 Claims, 4 Drawing Sheets

COMPACT RECOIL SPRING BUFFER APPARATUS

RELATED APPLICATIONS

This application claims priority to U.S. Provisional Patent Application No. 63/199,236, filed Dec. 15, 202, and incorporates the same herein by reference.

BACKGROUND

The present invention relates to firearms, and more particularly, to a novel recoil spring buffer apparatus to relocate the recoil spring and buffer assembly of an AR-pattern (AR15/M16/M4/AR10 or pistol caliber carbine versions thereof) firearm.

The AR-pattern firearm has an overall length disadvantage when compared to other firearm platforms due to the receiver extension mounted on the aft end of the lower receiver that houses the buffer and recoil spring. This is most limiting when using the platform to build a short barreled rifle, pistol, or other compact variant of the firearm. Due to the 9.5-inch installed length of a standard AR receiver extension, the overall length of an AR platform rifle or pistol has a fairly large minimum overall receiver length of 18.22 inches.

Other existing devices designed to make the AR-pattern upper/lower receiver set more compact either use a high degree of proprietary parts, are not operable with the firearm in its most compact form, or do not shorten the overall length of the receiver by an appreciable amount.

A need exists for a recoil spring buffer apparatus to relocate the recoil spring and buffer assembly of an AR-pattern firearm which is capable of relocating these components to a more space-efficient location.

SUMMARY

In one aspect, an AR-pattern firearm comprises an upper receiver, a housing positioned above the upper receiver and containing a recoil spring assembly, a bolt carrier assembly positioned in the upper receiver, and a bridge plate operably connecting the bolt carrier assembly to the recoil spring assembly. Discharge of the firearm causes rearward movement of the bolt carrier assembly out of battery and hence rearward movement of the bridge plate which stores energy in the recoil spring assembly, whereupon the stored energy in the recoil spring assembly causes the bolt carrier assembly to move forward back into battery.

The housing can be integral with the upper receiver or separate from the upper receiver and connected thereto with fasteners. The upper receiver can include an accessory rail thereon, with the housing connected to the accessory rail of the upper receiver. The housing can include an accessory rail thereon. The recoil spring assembly can include a compression spring. The firearm can further include a recoil buffer rearward of the bolt carrier assembly, the bridge plate operably connecting the recoil buffer to the recoil spring assembly.

The recoil spring assembly can comprise a guide rod, a recoil spring encircling the guide rod, a spring retainer secured to a forward end of the guide rod, and a guide rod bushing positioned in a rearward end of the housing and encircling the guide rod, with the bridge plate secured to a rearward end of the guide rod. The firearm can further include an end cap secured to a rearward end of the housing and capturing the guide rod, recoil spring, spring retainer, and guide rod bushing within the housing.

The firearm can further comprise a recoil buffer rearward of the bolt carrier assembly, the bridge plate operably connecting the recoil buffer to the recoil spring assembly, and a lower receiver having an interface opening, a receiver end plate abutting a rearward end of the lower receiver, and an extension nut threaded into the interface opening and capturing the receiver end plate between the extension nut and lower receiver, a rearward end of the recoil buffer received in the extension nut.

In another aspect, a recoil assembly for an AR-pattern rifle comprises a housing adapted to be positioned above an upper receiver, a recoil spring assembly positioned in the housing, a recoil buffer adapted to be positioned rearward of a bolt carrier assembly, and a bridge plate operably connecting the recoil buffer to the recoil spring assembly.

The housing can include an accessory rail thereon. The recoil spring assembly can comprise a guide rod, a recoil spring encircling the guide rod, a spring retainer secured to a forward end of the guide rod, and a guide rod bushing positioned in a rearward end of the housing and encircling the guide rod, with the bridge plate secured to a rearward end of the guide rod.

The recoil assembly can further comprise an end cap secured to a rearward end of the housing and capturing the guide rod, recoil spring, spring retainer, and guide rod bushing within the housing. The recoil assembly can further comprise an extension nut adapted to be threaded into an interface opening of a lower receiver, a rearward end of the recoil buffer received in the extension nut.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
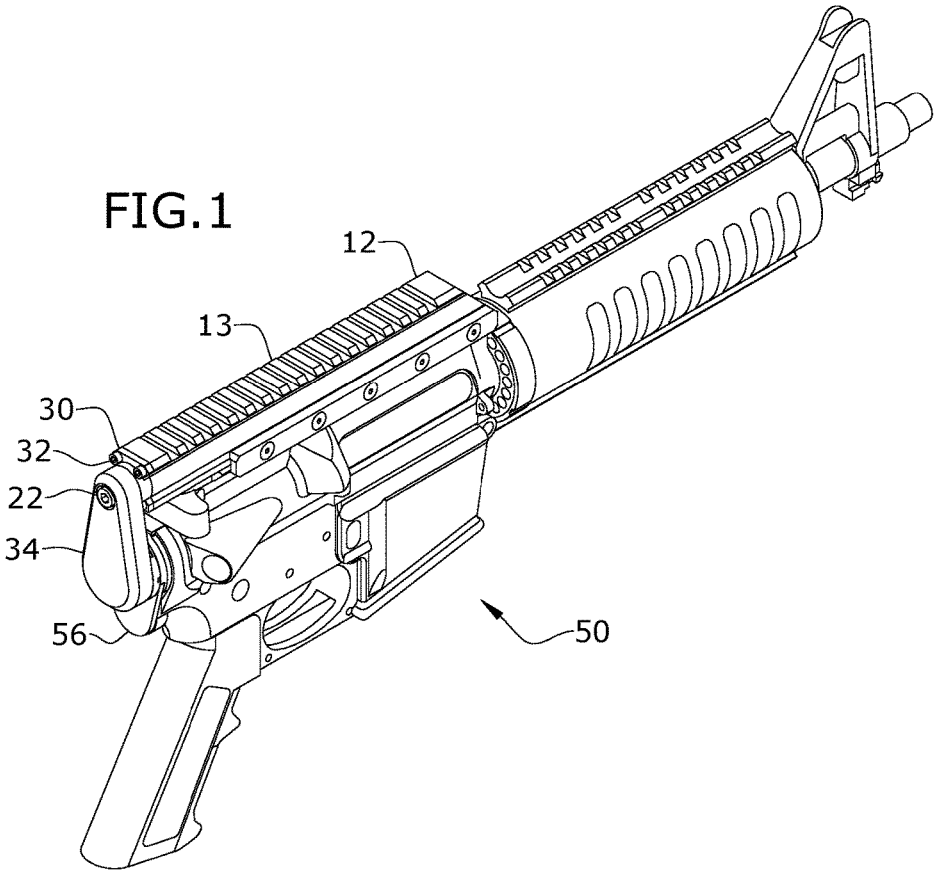
FIG. 1 is an isometric view of an exemplary embodiment of the present invention, shown in use on an AR-pattern firearm.

The following detailed description is of the best currently contemplated modes of carrying out exemplary embodiments of the invention. The description is not to be taken in a limiting sense, but is made merely for the purpose of illustrating the general principles of the present invention. With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Broadly, an embodiment of the present invention provides a provides a recoil spring buffer apparatus to relocate the recoil spring and buffer assembly of an AR-pattern firearm, which relocates the recoil spring and buffer assembly entirely to a more space-efficient location.

As stated hereinabove, the AR-pattern firearm has an overall length disadvantage when compared to other rifle platforms due to the receiver extension mounted on the aft end of the lower receiver that houses the buffer and recoil spring. This is most limiting when using the platform to build a short barreled rifle, pistol, or other compact variant of the firearm. Due to the 9.5" installed length of a standard AR-pattern receiver extension the overall length of an AR-pattern rifle or pistol has a fairly large minimum overall receiver length of 18.22". The present invention resolves this problem by being constructed and arranged to relocate the buffer and recoil spring assembly onto the top of the upper receiver. This reduces the overall length of the functioning upper/lower receiver group of the AR-pattern variant by approximately 9", making for a much more compact overall platform.

The present invention differs from and distinguishes over what currently exists. The present invention is constructed and arranged to provide and produce an operable firearm that is in a fully functional state with no structure or attachments aft of the pistol grip. Furthermore, the present invention may be utilized with all stock mil-spec parts, only replacing the buffer, receiver extension, and spring assembly.

The present invention provides an unprecedented improvement over previous options which seek to reduce the overall size of the AR-pattern firearm either are non-operable in their most compact state or do not completely eliminate the lower receiver extension and buffer assembly.

Instead of only altering the current AR-pattern design by either shortening or temporarily disconnecting the buffer/spring assembly, the present invention is constructed and arranged to relocate these components entirely to a more space-efficient location.

Other solutions that integrate the recoil spring into the upper receiver do so by using a nonstandard, proprietary upper receiver design. The present invention provides a solution that can be retrofit with existing standard AR-pattern upper receivers.

Referring now to FIGS. 1-7, in an exemplary embodiment, the present invention provides a recoil spring buffer apparatus 10 to relocate the recoil spring and buffer assembly of an AR-pattern firearm. The apparatus is constructed and arranged to relocate the recoil spring and buffer assembly entirely to a more space-efficient location.

FIG. 1 shows a perspective view of an exemplary embodiment of the present invention, shown in use. The recoil spring buffer apparatus in accordance with the present invention is shown generally at 10. The spring tube 12; the picatinny rail 13; the guide rod screws 22; the spring tube body end cap 30; the cap screws 32; and the bridge plate 34, the gun or firearm 50 and the receiver end plate 56 are shown with particularity.

Figure 2:
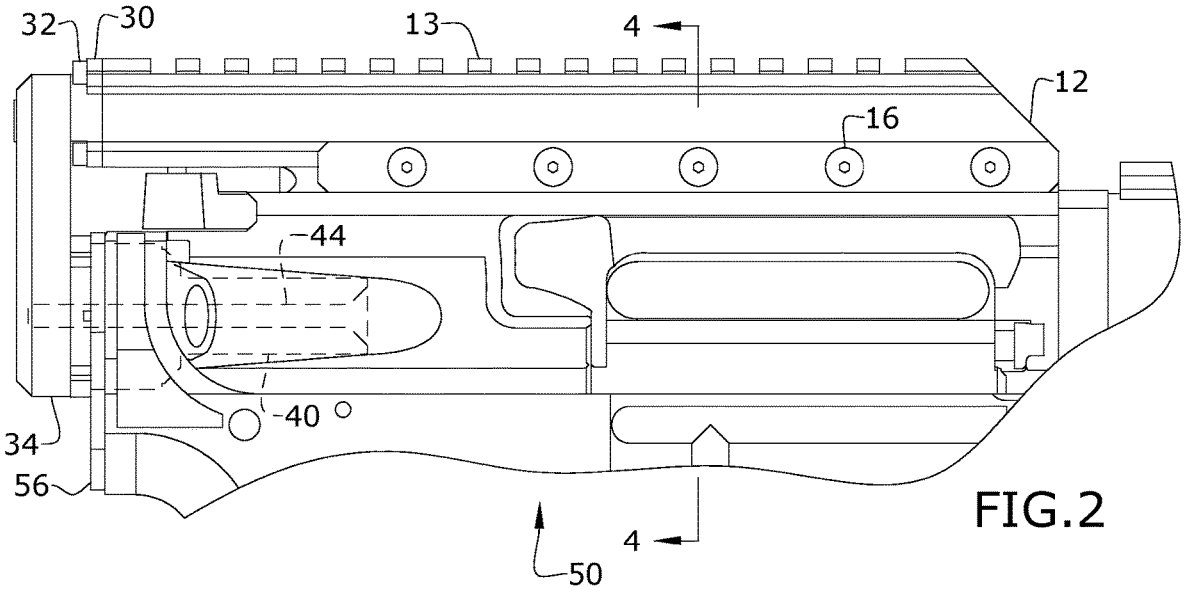
FIG. 2 is a side view of an exemplary embodiment of the present invention, shown in-use.

FIG. 2 provides a side view of an exemplary embodiment of the present invention, shown in-use. The spring tube 12; the picatinny rail 13; the picatinny rail clamp screws 16; the guide rod screws 22; the spring tube body end cap 30; the cap screws 32; and the bridge plate 34, the buffer; the gun or firearm 50 and the receiver end plate 56 are shown with particularity.

Figure 3:
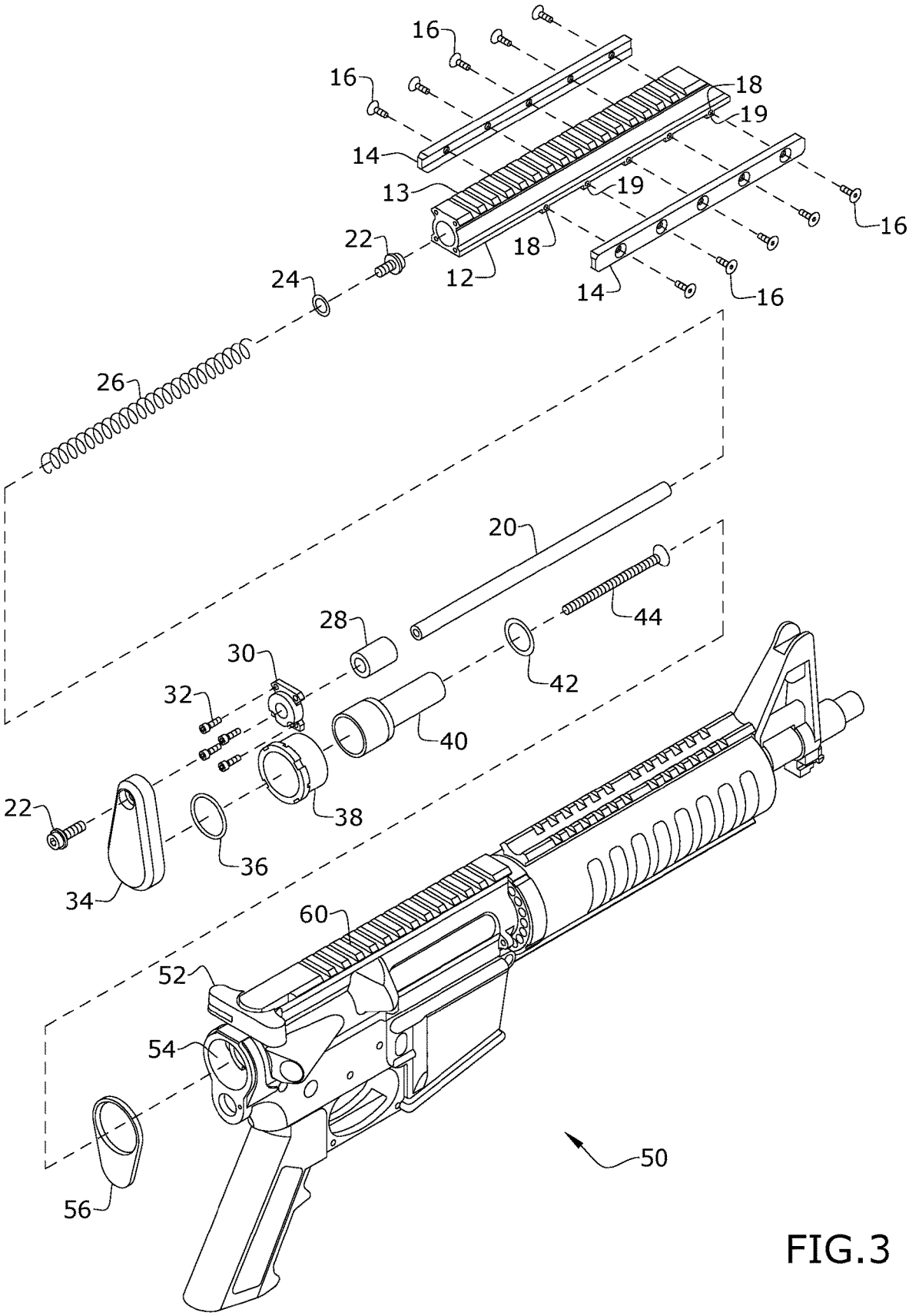
FIG. 3 is an exploded isometric view of an exemplary embodiment of the present invention.

FIG. 3 shows an exploded view of an exemplary embodiment of the present invention. The spring tube 12; the picatinny rail 13; picatinny rail clamps 14; the picatinny rail clamp screws 16; the openings 18 for the picatinny rail clamp screws 16; the picatinny rail indexing bosses 19; the guide rod 20; the guide rod screws 22; the spring retaining bolt washer 24; the recoil spring 26; the guide rod bushing 28; the spring tube body end cap 30; the cap screws 32; the bridge plate 34; the O-ring 36; the extension nut 38; the buffer shell 40; the buffer washer 42; the buffer bolt 44; the gun or firearm 50; the charging handle 52; the buffer/bolt carrier interface opening 54; the receiver end plate 56; the bolt carrier 58; and the gun or firearm picatinny rail are shown with particularity.

Figure 4:
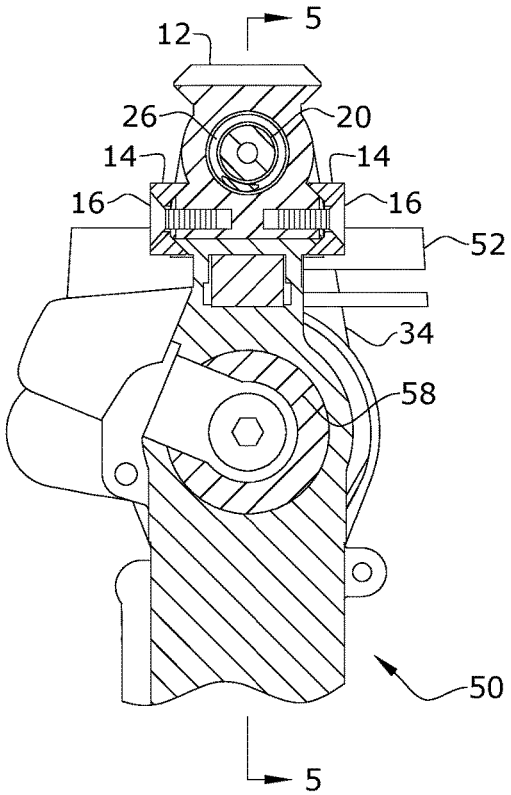
FIG. 4 is a section view taken along line 4-4 of FIG. 2 to show further detail.

FIG. 4 provides a section view taken substantially along line 4-4 of FIG. 2 to show further detail. The spring tube 12; the picatinny rail clamps 14; the picatinny rail clamp screws 16; the guide rod 20; the recoil spring 26; the bridge plate 34; the gun or firearm 50 and the bolt carrier 58 are shown with particularity.

Figure 5:
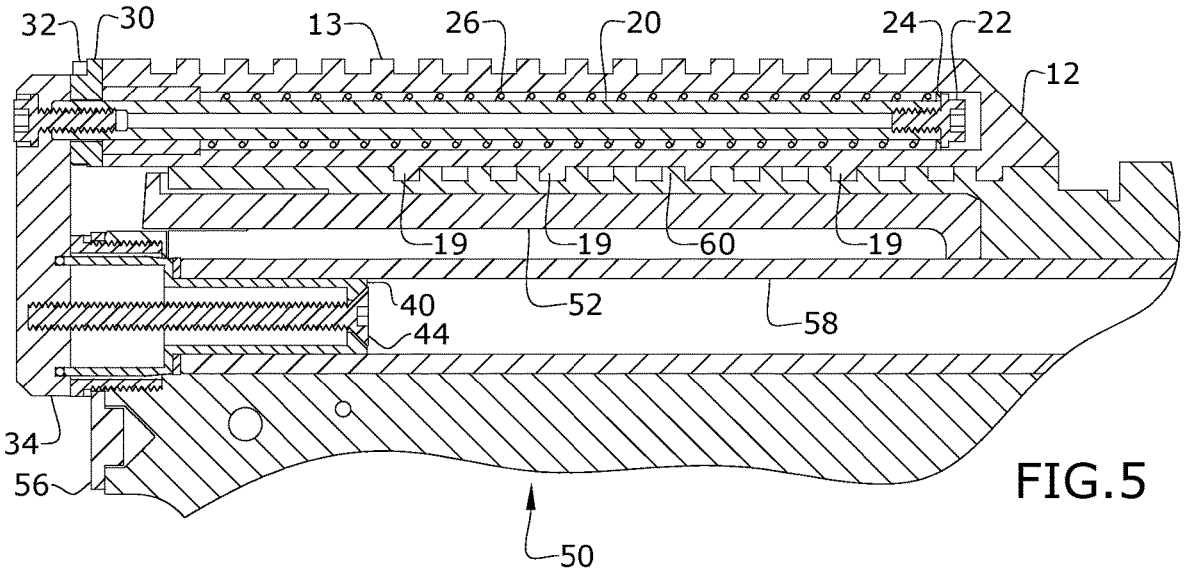
FIG. 5 is a section view taken along line 5-5 of FIG. 4 to show further detail.

FIG. 5 provides a section view taken along line 5-5 of FIG. 4 to show even further detail. The spring tube 12; the picatinny rail 13; the picatinny rail indexing bosses 19; the guide rod 20; the guide rod screws 22; the spring retaining bolt washer 24; the recoil spring 26; the spring tube body end cap 30; the cap screws 32; the bridge plate 34; the buffer 40; the buffer bolt 44; the gun or firearm 50; the charging handle 52; the receiver end plate 56; the bolt carrier 58 and the gun or firearm accessory rail 60 are shown with particularity.

Figure 6:
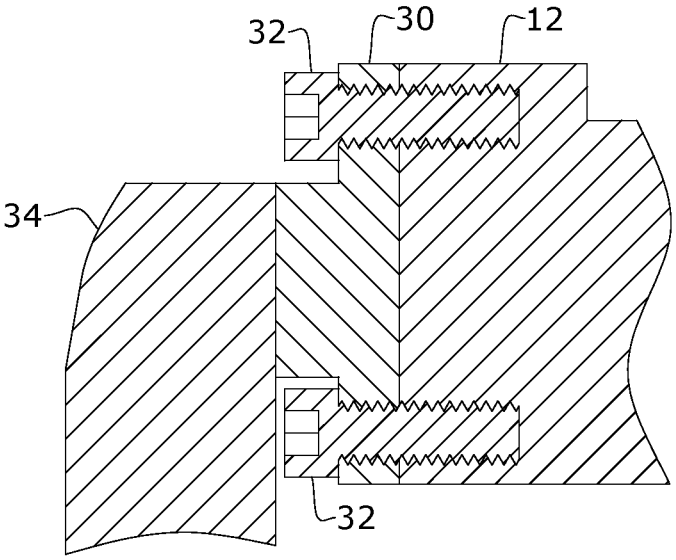
FIG. 6 is a fragmentary detail view of the cap screws in accordance with an exemplary embodiment of the present invention.

FIG. 6 shows a detail view of the cap screws in accordance with an exemplary embodiment of the present invention. The spring tube 12; the spring tube body end cap 30; the cap screws 32 and the bridge plate 34 are shown with particularity.

Figure 7:
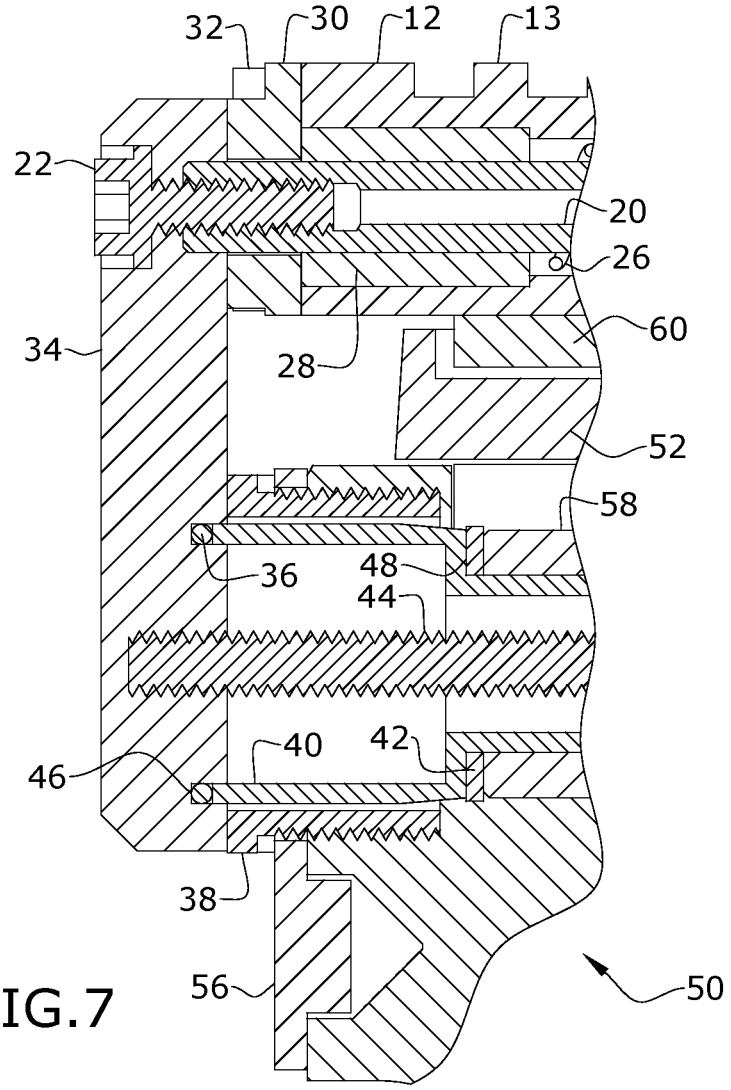
FIG. 7 is a fragmentary enlarged detail view in accordance with an exemplary embodiment of the present invention.

FIG. 7 provides an enlarged detail view in accordance with an exemplary embodiment of the present invention. The spring tube 12; the picatinny rail 13; the guide rod 20; the guide rod screws 22; the recoil spring 26; the guide rod bushing 28; the spring tube body end cap 30; the cap screws 32; the bridge plate 34; the O-ring 36; the extension nut 38; the buffer 40; the buffer washer 42; the buffer bolt 44; the recess 46 for the buffer 40; the shoulder 48 for the buffer washer 42; the gun or firearm 50; the charging handle 52; receiver end plate 56; the bolt carrier 58 and the gun or firearm picatinny rail 60 are shown with particularity.

In an exemplary embodiment, the components or elements of the recoil spring buffer apparatus 10 relate in the following manner. The spring tube 12 is the main chassis of the device. The guide rod 20, recoil spring 26, guide rod screw 22, spring retaining washer 24, bridge plate/buffer connector 34, buffer 40, buffer bolt/screw 44, connector/guide rod screw 22, buffer O-ring 36, weight (which may comprise powdered tungsten) held within an interior portion of the buffer 40, and a buffer shim (if required) 42, may be fastened together in a unit that comprises the reciprocating assembly. The reciprocating assembly may be held into the spring tube 12 via cap screws 32. The guide rod bushing 28 may be held into the spring tube 12 by the end cap 30, and cap screws 32. The bushing 28 may support the guide rod 20 and retains its position central and parallel to the inner bore of the spring tube 12. The recoil spring 26 may be held in compression on the guide rod 20 via the guide rod screw 22 and spring retaining washer 24 on one end and the guide rod bushing 28, end cap 30, bridge plate 34, and guide rod/connector screw 22 at an opposite end.

In an exemplary embodiment, the spring tube 12 may be made out of billet aluminum machined to specification or out of a solid extrusion. In each instance, final machining will create the features of the main bore, accessory rail profile, accessory rail indexing bosses, fastener holes, etc.

In an exemplary embodiment, a weight (not shown), such as, for example without limitation, powdered tungsten, may be included inside a hollow shell of the buffer 40 which may be sealed to the bridge plate 34 with the buffer O-ring 36 and attached via the buffer screw 44. The accessory rail clamps 14 may be bolted to the spring tube 12 via the rail clamp screws 16. The accessory rail clamps 14 along with the lower profile of the spring tube 12 and indexing bosses 19 may provide a means of attachment to a gun or firearm upper receiver accessory rail 60. The receiver end plate 56 may be secured to the lower receiver of the firearm via the extension nut 38. The buffer 40 may pass through the extension nut 38 to interface with the bolt carrier group of the firearm.

In an exemplary embodiment of the present invention, the invention may work in the following manner. This apparatus and assembly 10 may be mounted onto the top accessory rail section of a standard AR-pattern upper receiver and may be held firmly via the accessory rail clamps 14 and rail clamp screws 16. The extension nut 38 may be threaded and may screw into the threads normally used by the stock AR-pattern receiver extension. The extension nut 38 may serve to retain the receiver end plate 56 and may also act as a guide bushing to ensure that the buffer 40 and related assembly returns accurately at the end of a fore and aft cycling of the device 10. When the weapon is fired, aft movement of the stock AR-pattern bolt carrier group acts on the buffer 40 via direct interface of the aft portion of the bolt carrier 58 and shoulder of the buffer 40. A shim 42 may be used if required to fine tune fitment if required. In use, the force of the recoil of the bolt carrier group is resisted by force of the recoil spring 26 and by the total mass made up of the buffer 40 shim (if required) 42, buffer O-ring 36, buffer screw 44, bridge plate 34, guide rod screws 22, guide rod 20, spring retainer washer 24, and weight (such as, for example without limitation, powdered tungsten), which may be housed within the hollow buffer 40.

The hollow buffer 40 may be filled with a weight (not shown), such as, for example without limitation, an amount of powdered tungsten to fine tune weight and allow for a dead-blow action to dampen out possibility for the assembly to bounce at the end of a cycle. The smaller diameter portion of the buffer 40 is designed to have a high-tolerance fit into the hollow in the aft portion of a stock AR-pattern bolt carrier. This helps keep the apparatus and assembly in alignment with the bolt carrier and to limit relative movement between the bolt carrier and complete reciprocating assembly. The aft force of the bolt carrier group 58 is transferred via direct interface to the buffer 40 to the bridge plate 34 to the guide rod 20 which slides aft in the bushing 28, transferring that force into the recoil spring 26 as the reciprocating assembly moves aft. After the energy of the bolt carrier movement has been absorbed by the apparatus and assembly, the stored spring force is then utilized to operate the apparatus and assembly in reverse and move the bolt carrier 58 back into battery.

In an exemplary embodiment, the apparatus of the present invention may be made in the following manner. Producing this apparatus and assembly begins with a raw extrusion that is in the basic cross-sectional profile of the spring tube 12. That extrusion may then be cut to length. In some embodiments, the spring tube 12 can also be milled out of solid aluminum billet material. This unfinished spring tube may then be machined to cut the accessory rail section into the top surface and chamfer the non-operating end at 45 degrees. The center of the spring tube 12 may then be bored out to provide a cavity for the guide rod 20, bushing 28 and spring 26 assembly. Holes may then be drilled to allow the clamp screws 16 and cap screws 32. The buffer connector may be milled via CNC out of aluminum alloy billet. The mill may cut the profile of the part and drill the through-hole for the connector screw, a blind hole for the buffer screw, and cut the groove for the buffer O-ring. The hole for the buffer screw may then be tapped via machine. The extension nut 38 may be turned and threaded on a lathe and may have its wrench indexing grooves cut on a mill. The receiver end plate 56 may be produced on a CNC mill from aluminum alloy billet. The buffer may be turned on a lathe from aluminum bar stock. If desired, a shock-absorbing urethane bushing (not shown) can be provided between the bushing and spring housing end cap 30 to dampen the impulse if/when the assembly hits its travel limit on an over-gassed setup.

The Picatinny (1913 MIL-SPEC) accessory rail profile may be considered optional and may be milled into the top surface of the spring tube. In some embodiments, this rail accessory may be omitted if a lower overall profile is desired.

In an exemplary embodiment, the weight inside the buffer is necessary: in some embodiments, as an alternative to powdered tungsten, a series of free moving donut style weights could be housed inside the buffer and cushioned with O-rings, if a less expensive and easier to assemble alternative to powdered tungsten is desired.

In some embodiments, an integral iron sight could be added to a shortened spring tube 12 with the accessory rail 13 omitted if a low-profile, fixed sight option is desired. The spring tube 12 could be made in a shorter top to bottom profile by removing the integral accessory rail 13. This flat-top spring tube 12 could then be drilled and tapped to attach commercially available accessory rails, sights, or other attachments instead of using an integral accessory rail.

In some embodiments the retaining of the bushing and reciprocating assembly could also be done via other means, such as cross-drilled spring pins or a press fit between busting and spring tube bore. The method of attachment of the spring tube 12 to the upper receiver of the weapon may also be accomplished via various means, including a quick-disconnect style accessory rail mount, sliding dovetailed clamp style rail mount, or any of the multitude of ways various firearm accessories are mounted to accessory rails. A gas cylinder (not shown) could potentially be used in lieu of a guide rod 20 and recoil spring 26 or the spring tube 12 and recoil spring 26 could possibly be mounted along the side of the upper receiver instead of on top of the upper receiver. Additionally, the spring tube assembly could be integrated into an upper receiver as a single unit to provide a more space-efficient option. The spring tube 12 could also be moved farther forward onto the top section of a receiver mounted hand guard and made integral to the hand guard and utilize a longer shaft running along the top of the upper receiver back to the buffer connector. In addition, in a version with the recoil spring assembly mounted forward of the upper receiver a gas piston operated version of this device could be made where the guide rod 20 also acts as an operating rod for the bolt carrier group. By utilizing a piston operated bolt carrier instead of a direct impingement gas system, a shortened bolt carrier could be used to eliminate any externally reciprocating parts.

In an exemplary embodiment, the present invention may be installed on an existing AR-pattern rifle or pistol by removing the recoil spring and buffer out of the lower receiver extension of the firearm then unscrewing the receiver extension and removing it completely. The receiver end plate 56 and receiver extension jamb nut may also then be removed. The receiver end plate and extension nut may then be installed onto the lower receiver with the threads of the end collar passing through the hole in the receiver end plate and threading into the mounting location of the stock receiver extension tube. The assembled spring tube and buffer assembly may then be mounted onto the accessory rail 60 that is milled into the top surface of the upper receiver. The buffer with the buffer shim installed over the smaller diameter portion of the buffer is passed through the hollow extension nut and the lesser diameter portion of the buffer indexes inside the hollow portion of the bolt carrier group. The spring tube may then be positioned along the upper receiver in a fore-aft location that allows a 0.010"-0.015" gap between the forward face of the bridge plate/buffer connector and the aft face of the spring tube with a similar gap between the bridge plate buffer connector and end collar. This gap may be measured with the bolt carrier group in its farthest forward movement with the large diameter of the buffer and extension nut/buffer shim being held against the aft face of the bolt carrier via spring pressure. Once the spring tube 12 is positioned properly it may be clamped firmly to the upper receiver by tightening the clamp screws 16. Once installed, the firearm may operate normally. If the user wishes to disassemble the firearm, the user may hold the bolt carrier 58 forward by closing the ejection port cover and holding it closed while gripping the buffer connector and pulling it aft. Once the buffer has been withdrawn fully from the bolt carrier and is free of the lower receiver, it may be rotated to the side and released. The upper and lower receivers may be separated for cleaning and maintenance in this condition. To re-couple the buffer and bolt carrier 58, the buffer connector may again be gripped and drawn aft and then rotated to allow the buffer to re-index into the back of the bolt carrier 58. This invention may be installed on a new firearm during production or assembled in exactly the same manner, only omitting removal of the stock receiver extension and related parts, as they may not yet have been installed on a new build.

In summary, in an exemplary embodiment, the present invention provides an apparatus to relocate the recoil spring and buffer assembly of an AR-pattern firearm. Instead of only altering the current AR-pattern design by either shortening or temporarily disconnecting the buffer/spring assembly, the apparatus of the present invention provides an unprecedented design constructed and arranged to relocate these components entirely to a more space-efficient location.

For clarity, only those aspects of the system germane to the invention are described, and product details well known in the art are omitted. In addition, many embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the present invention. While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An AR-pattern firearm, comprising:

an upper receiver, a housing positioned above said upper receiver and containing a recoil spring assembly, a bolt carrier assembly positioned in said upper receiver, and a bridge plate operably connecting said bolt carrier assembly to said recoil spring assembly exterior of the upper receiver and housing, whereby discharge of said firearm causes rearward movement of said bolt carrier assembly out of battery and hence rearward movement of said bridge plate which stores energy in said recoil spring assembly, whereupon the stored energy in said recoil spring assembly causes said bolt carrier assembly to move forward back into battery.

2. The firearm of claim 1 wherein said housing is integral with said upper receiver.

3. The firearm of claim 1 wherein said housing is separate from said upper receiver and is connected thereto with fasteners.

4. The firearm of claim 3 wherein said upper receiver includes an accessory rail thereon, said housing connected to said accessory rail of said upper receiver.

5. The firearm of claim 4 wherein said housing includes an accessory rail thereon.

6. The firearm of claim 1 wherein said recoil spring assembly includes a compression spring.

7. The firearm of claim 1 further including a recoil buffer rearward of said bolt carrier assembly, said bridge plate operably connecting said recoil buffer to said recoil spring assembly.

8. The firearm of claim 1 wherein said recoil spring assembly comprises:

a guide rod, a recoil spring encircling said guide rod, a spring retainer secured to a forward end of said guide rod, and a guide rod bushing positioned in a rearward end of said housing and encircling said guide rod, said bridge plate being positioned exterior to and rearward of the upper receiver and housing and is secured to a rearward end of said guide rod.

9. The firearm of claim 8 further including an end cap secured to a rearward end of said housing and capturing said guide rod, recoil spring, spring retainer, and guide rod bushing within said housing.

10. The firearm of claim 9 further comprising:

a recoil buffer rearward of said bolt carrier assembly, said bridge plate operably connecting said recoil buffer to said recoil spring assembly, and a lower receiver having an interface opening, a receiver end plate abutting a rearward end of said lower receiver, and an extension nut threaded into said interface opening and capturing said receiver end plate between said extension nut and lower receiver, a rearward end of said recoil buffer received in said extension nut.

11. A recoil assembly for an AR-pattern rifle, comprising:

a housing adapted to be positioned above an upper receiver, a recoil spring assembly positioned in said housing, a recoil buffer adapted to be positioned rearward of a bolt carrier assembly, and a bridge plate positioned exterior to and rearward of the upper receiver and housing and operably connecting said recoil buffer to said recoil spring assembly.

12. The recoil assembly of claim 11 wherein said housing includes an accessory rail thereon.

13. The recoil assembly of claim 11 wherein said recoil spring assembly comprises:

a guide rod, a recoil spring encircling said guide rod, a spring retainer secured to a forward end of said guide rod, and a guide rod bushing positioned in a rearward end of said housing and encircling said guide rod, said bridge plate secured to a rearward end of said guide rod.

14. The recoil assembly of claim 13 further comprising an end cap secured to a rearward end of said housing and capturing said guide rod, recoil spring, spring retainer, and guide rod bushing within said housing.

15. The recoil assembly of claim 11 further comprising:

an extension nut adapted to be threaded into an interface opening of a lower receiver, a rearward end of said recoil buffer received in said extension nut.

16. The firearm of claim 1 wherein the bridge plate is positioned rearward of the upper receiver and housing.

* * * * *